US005368453A

United States Patent [19]

Peng

[11] Patent Number: 5,368,453

[45] Date of Patent: Nov. 29, 1994

[54] ELECTRIC FAN

[76] Inventor: Jung C. Peng, P.O. Box 82-144, Taipei, Taiwan, Prov. of China

[21] Appl. No.: 159,465

[22] Filed: Nov. 30, 1993

[51] Int. Cl.[5] ..... F04B 17/00

[52] U.S. Cl. ..... 417/423.5; 417/423.14; 415/121.2; 415/211.2; 415/220; 416/120; 416/247 R

[58] Field of Search ..... 417/423.5, 423.6, 423.7, 417/423.9, 423.14, 424.1, 234; 415/121.2, 124.1, 211.2, 203, 220; 416/120, 247

[56] References Cited

U.S. PATENT DOCUMENTS 5,193,984 3/1993 Lin ..... 416/247 R
5,230,604 7/1993 Glaser et al. ..... 416/120
5,256,039 10/1993 Crawford ..... 417/234

FOREIGN PATENT DOCUMENTS 313545 12/1933 Italy ..... 416/247 R

*Primary Examiner*—Richard A. Bertsch
*Assistant Examiner*—Alfred Basichas
*Attorney, Agent, or Firm*—Alfred Lei

[57] ABSTRACT

An electric fan including a hood having a plurality of tubular members in each of which there is a cylindrical member, a plurality of bell-shaped members each mounted on each of said tubular members, and a plurality of protecting covers each mounted on an outlet of each of said tubular members, and a base portion mounted under said hood and having a motor provided with an output gear engaged with a plurality of fan gears each fixedly mounted on an axle extending from said base portion upwardly into said cylindrical member, and a plurality of impellers each mounted on the top end of said axle, whereby the electric fan can make air currents in a range of 360 degrees.

2 Claims, 4 Drawing Sheets

ELECTRIC FAN

BACKGROUND OF THE INVENTION

It has been found that the conventional electric fan is a device consisting of one or more revolving blades or vanes attached to a rotary hub and operated by a motor. However, such electric fan can make an air current in a range of 120 degrees only. Hence, an electric fan of which the head can be rotated has been developed, but this kind of electric fan can only provide an air current in a range of 180 degrees and is short in service life. Further, it is often heard that the children put their fingers or insert something into the fan and get severe hurt to their hands.

Therefore, it is an object of the present invention to provide an improved electric fan which may obviate and mitigate the above-mentioned drawbacks.

SUMMARY OF THE INVENTION

This invention relates to an improved electric fan.

It is the primary object of the present invention to provide an electric fan which will make air currents in a range of 360 degrees.

It is another object of the present invention to provide an electric fan which is simple in construction.

It is still another object of the present invention to provide an electric fan which is fit for practical use.

It is still another object of the present invention to provide an electric fan which is safe in use.

It is a further object of the present invention to provide an electric fan which is inexpensive to manufacture.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
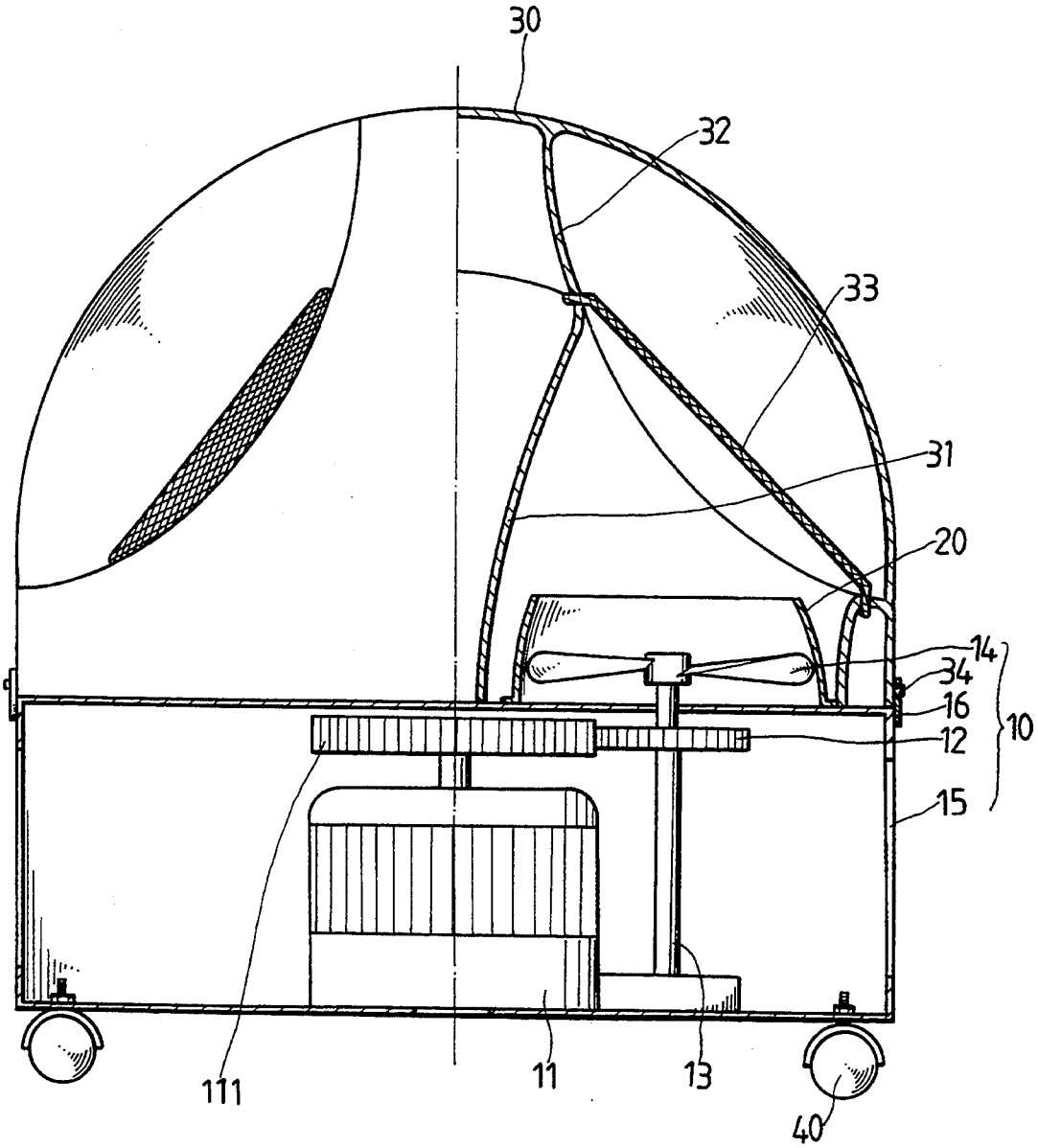
FIG. 1 is a sectional view of the present invention.
Figure 2:
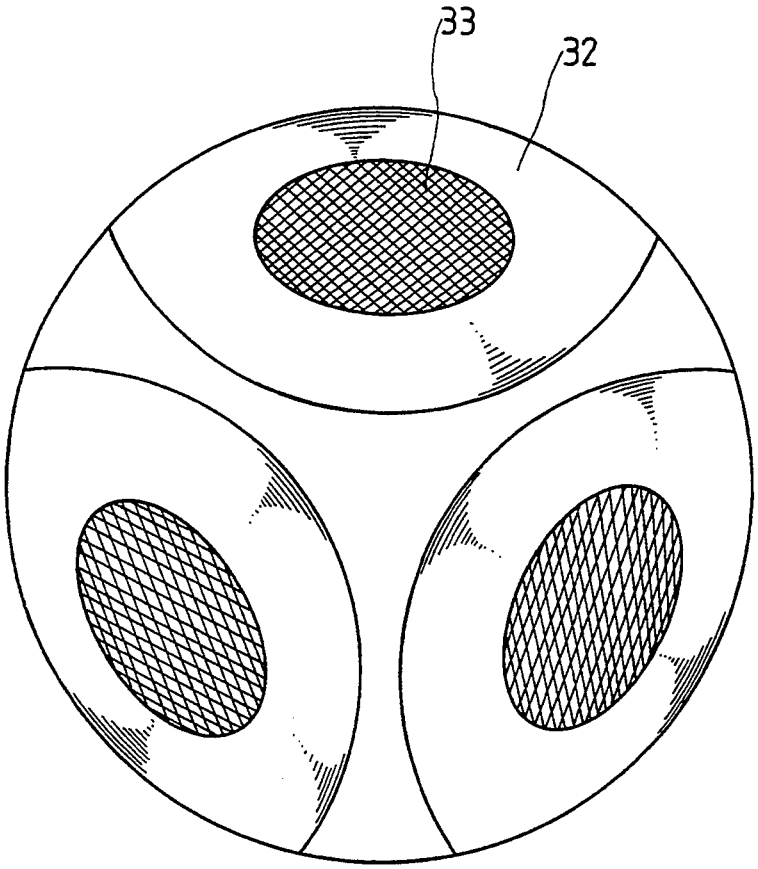
FIG. 2 is a top view of the present invention.
Figure 3:
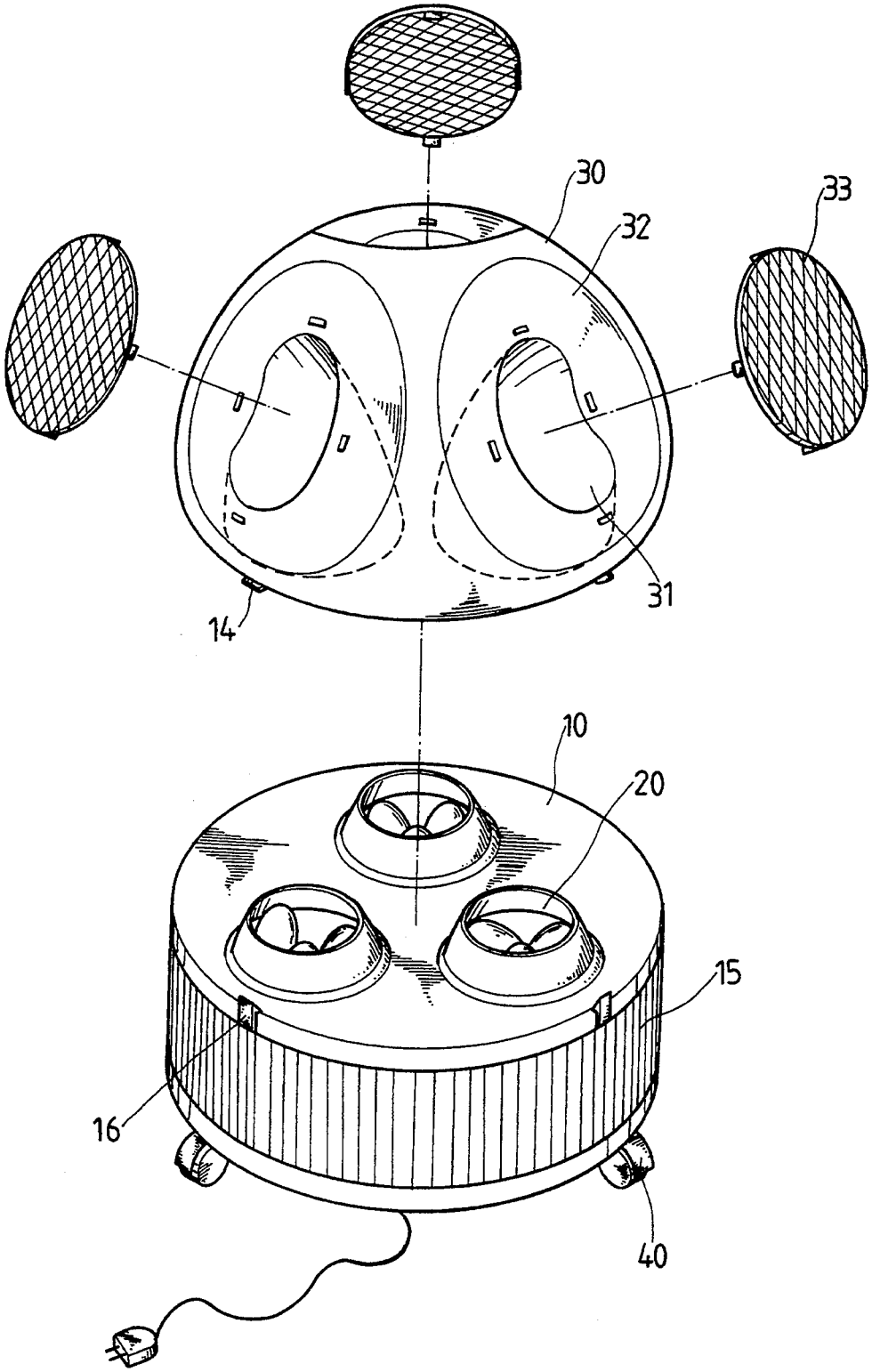
FIG. 3 is an exploded view of the present invention.
Figure 4:
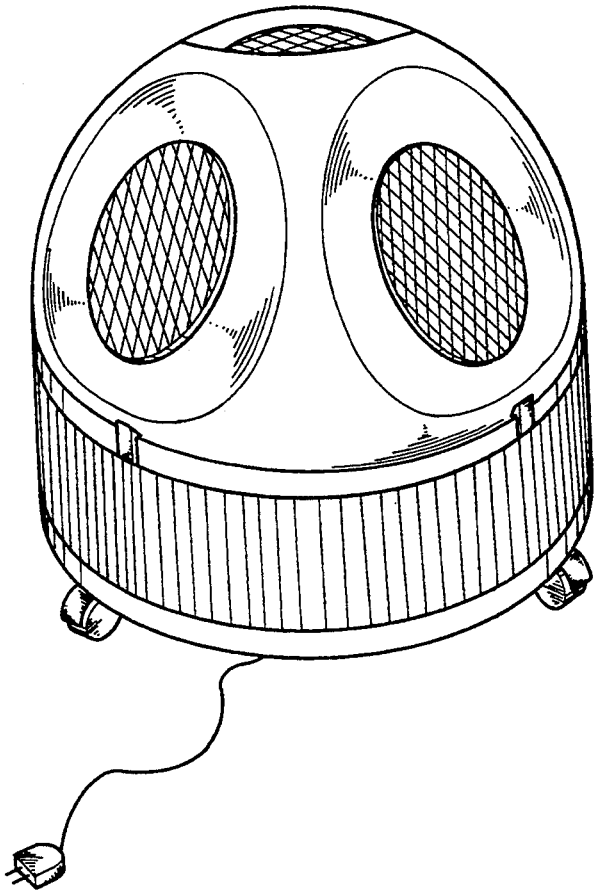
FIG. 4 is a perspective view of the present invention.

With reference to the drawings and in particular to FIGS. 1 and 3 thereof, the electric fan according to the present invention mainly comprises a base portion 10 and a hood 30. The hood 30 is a hemispherical casing formed with three equidistant tubular members 31 in each of which there is a cylindrical member 20. A bell-shaped member 32 is mounted on each of the tubular members 31 (see FIGS. 2 and 4). A protecting cover 33 is mounted on the outlet of each of the tubular members 31. Further, the hood 30 is provided with a plurality of hooks 14 at the lower edge.

The base portion 10 is provided with a plurality of fastening means for engaging the hooks 14 of the hood 30. In the base portion 10 there is fitted a motor 11. The motor 11 is provided with an output gear 111 engaged with three equidistant fan gears 12 each fixedly mounted on an axle 13 extending from the base portion 10 upwardly into a corresponding cylindrical member 20 of the hood 30. On the top end of the axle 13 is mounted an impeller 14 which is disposed within the cylindrical member 20 of the hood 30. The base portion 10 is further provided with a plurality of rollers 40 so as to facilitate the movement thereof. In addition, the base portion 10 is formed with an air inlet 15 at one side.

When the power supply to the present invention is turned on, the motor 11 will be rotated thereby rotating the output gear 111. In the meantime, the output gear 111 will drive the three fan gears 12 to rotate thus rotating the three impellers 14 and therefore making air currents for cooling. The bell-shaped members 32 are used to diversify the air currents in a range of 360 degrees. As is well known, hot air will go up and cold air will go down. Hence, the present invention will suck in and blow out cooler air than the conventional electric fan.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An electric fan comprising:

a hood having a plurality of tubular members in each of which there is a cylindrical member, a plurality of bell-shaped members each mounted on each of said tubular members, and a plurality of protecting covers each mounted on an outlet of each of said tubular members; and a base portion mounted under said hood and having a motor provided with an output gear engaged with a plurality of fan gears each fixedly mounted on an axle extending from said base portion upwardly into said cylindrical member, and a plurality of impellers each mounted on the top end of said axle.

2. The electric fan as claimed in claim 1, wherein said base portion is provided with a plurality of rollers at the bottom thereof.

* * * * *